US010161189B2

(12) United States Patent
Zupanick

(10) Patent No.: US 10,161,189 B2
(45) Date of Patent: Dec. 25, 2018

(54) SYSTEMS AND METHODS FOR DRILLING WELLBORES HAVING A SHORT RADIUS OF CURVATURE

(71) Applicant: Pine Tree Gas, LLC, Pineville, WV (US)

(72) Inventor: Joseph A. Zupanick, Pineville, WV (US)

(73) Assignee: Pine Tree Gas, LLC, Pineville, WV (US)

( * ) Notice: Subject to any disclaimer, the term of this patent is extended or adjusted under 35 U.S.C. 154(b) by 311 days.

(21) Appl. No.: 14/941,534

(22) Filed: Nov. 13, 2015

(65) Prior Publication Data

US 2016/0069138 A1 Mar. 10, 2016

Related U.S. Application Data

(62) Division of application No. 14/748,197, filed on Jun. 23, 2015, now Pat. No. 9,206,649.

(60) Provisional application No. 62/016,485, filed on Jun. 24, 2014.

(51) Int. Cl.

| | |
|---|---|
| ***E21B 7/08*** | (2006.01) |
| ***E21B 7/06*** | (2006.01) |
| ***E21B 4/18*** | (2006.01) |
| ***E21B 3/00*** | (2006.01) |

(52) U.S. Cl.

CPC ..... *E21B 7/067* (2013.01); *E21B 3/00* (2013.01); *E21B 4/18* (2013.01)

(58) Field of Classification Search

CPC ..... E21B 7/067; E21B 3/00; E21B 4/18

See application file for complete search history.

(56) References Cited

U.S. PATENT DOCUMENTS

| | | | |
|---|---|---|---|
| 1,850,403 | A | 3/1932 | Lee |
| 2,119,095 | A | 5/1938 | Brummett |
| 2,852,230 | A | 9/1958 | Garrison |
| 3,572,450 | A | 3/1971 | Thompson |
| 3,903,974 | A | 9/1975 | Cullen |

(Continued)

FOREIGN PATENT DOCUMENTS

| | | | |
|---|---|---|---|
| CN | 1299915 | A | 6/2001 |
| EP | 0467642 | A2 | 1/1992 |

OTHER PUBLICATIONS

Chinese Office Action and English Translation received in Chinese Application No. 2015800338909, dated Apr. 28, 2018, 18 pages.

(Continued)

*Primary Examiner* — Robert E Fuller

(74) *Attorney, Agent, or Firm* — Hubbard Johnston, PLLC

(57) ABSTRACT

Systems and methods are presented for drilling a wellbore with a portion having a short radius of curvature. The systems include a drill assembly having a motor and a tubular housing. An actuator is at least partially disposed within the tubular housing and couples the motor to the tubular housing. The actuator is configured to selectively articulate the drill assembly between a straight configuration and a bent configuration. At least one torque anchor is fluidly-coupled to a trailing end of the drill assembly. Methods are presented for selectively articulating the drill assembly to form the wellbore, including the portion having short radius of curvature. Other systems and methods are presented.

6 Claims, 9 Drawing Sheets

(56) References Cited

U.S. PATENT DOCUMENTS

| | | | | |
|---|---|---|---|---|
| 4,502,552 | A * | 3/1985 | Martini | |
| 4,655,299 | A | 4/1987 | Schoeffler | |
| 4,714,119 | A | 12/1987 | Hebert et al. | |
| 4,732,223 | A | 3/1988 | Schoeffler et al. | |
| 4,811,798 | A | 3/1989 | Falgout et al. | |
| 4,895,214 | A | 1/1990 | Schoeffler | |
| 5,002,138 | A | 3/1991 | Smet | |
| 5,094,304 | A | 3/1992 | Briggs | |
| 5,213,168 | A * | 5/1993 | Warren | |
| 5,265,687 | A | 11/1993 | Gray | |
| 5,297,641 | A | 3/1994 | Falgout | |
| 5,305,838 | A | 4/1994 | Pauc | |
| 5,409,060 | A | 4/1995 | Carter | |
| 5,423,389 | A * | 6/1995 | Warren | E21B 7/04 175/75 |
| 5,467,834 | A | 11/1995 | Hughes et al. | |
| 5,503,235 | A | 4/1996 | Falgout | |
| 5,547,031 | A | 8/1996 | Warren et al. | |
| 6,092,610 | A | 7/2000 | Kosmala et al. | |
| 6,364,034 | B1 | 4/2002 | Schoeffler | |
| 6,419,024 | B1 | 7/2002 | George et al. | |
| 6,516,900 | B1 | 2/2003 | Tokle | |
| 6,761,232 | B2 | 7/2004 | Moody et al. | |
| 7,445,059 | B1 * | 11/2008 | Falgout, Sr. | |
| 7,677,335 | B2 | 3/2010 | Cao et al. | |
| 8,104,548 | B2 | 1/2012 | Ma et al. | |
| 8,191,652 | B2 | 6/2012 | Kotsonis et al. | |
| 8,333,254 | B2 | 12/2012 | Hall et al. | |
| 2004/0079553 | A1 | 4/2004 | Livingstone | |
| 2004/0159466 | A1 | 8/2004 | Haugen et al. | |
| 2005/0150692 | A1 | 7/2005 | Ballantyne et al. | |
| 2009/0166089 | A1 | 7/2009 | Millet | |
| 2009/0188717 | A1 | 7/2009 | Haughom et al. | |
| 2012/0205092 | A1 | 8/2012 | Givens et al. | |
| 2014/0054087 | A1 | 2/2014 | Wang et al. | |

OTHER PUBLICATIONS

International Search Report and Written Opinion of the International Search Authority received in Patent Cooperation Treaty Application No. PCT/US2015/037283, dated Sep. 16, 2015, 8 pages.

* cited by examiner

SYSTEMS AND METHODS FOR DRILLING WELLBORES HAVING A SHORT RADIUS OF CURVATURE

RELATED APPLICATION

This application is a divisional of U.S. application Ser. No. 14/748,197 filed Jun. 23, 2015 entitled "Systems and Methods for Drilling Wellbores Having a Short Radius of Curvature," which claims the benefit of U.S. Provisional Application No. 62/016,485 filed Jun. 24, 2014 entitled, "Short Radius Drilling Assembly," both are incorporated herein by reference in their entirety for all purposes.

TECHNICAL FIELD

The present disclosure relates generally to systems and methods for drilling wellbores, and more specifically, for drilling wellbores with portions having a short radius of curvature.

BACKGROUND

Conventional downhole directional drilling motors often employ a ridged, bent housing such that the top and bottom of the motor assembly are aligned at a slight angle, typically less than 3 degrees. This angle determines the degree of curvature of the well-path. Rotary-steerable drilling assemblies utilize selectively-engaged push pads or variable geometry stabilizers to change the orientation of the motor with respect to the wellbore. In those configurations, the eccentric attitude of the motor or the bit determines the projected path of the motor.

SUMMARY

The following disclosure relates to an improved downhole drilling system capable of exiting a pre-drilled vertical well, and then continuing on to drill an ultra-short radius horizontal well. In the present disclosure, a downhole motor is configured with a flexible bent-housing assembly that allows the bend angle or build rate of the motor to be selectively changed while drilling. The bend angle may be 20 degrees or more. In the same selective manner, up-hole of the motor, one or more anti-torque devices engage against the wall of the wellbore and limit a reactionary torque of the drill motor from being transmitted to the carrier string. When no building angle is desired, the motor assembly defaults to a straight-hole configuration. This configuration allows short-radius drilling into desired formations.

Described herein is a directional drilling system capable of drilling ultra-short radius wells. Once deployed to the desired downhole location, the drill motor is designed to selectively articulate between a straight configuration and a bent configuration. This design allows directional drilling with a downhole motor geometry, the shape of which when in the bent configuration is unable to pass through a straight section of wellbore.

In some embodiments, the upper and lower motor assemblies are joined by an elastomer element that is capable of flexing between the straight and bent configuration. The elastomer element may be reinforced with fabric cord or steel wire to provide the correct amount of rigidity, while still allowing the desired bending movement. In other embodiments, the upper and lower motor assembly are mechanically hinged so as to provide a single axis of movement.

A piston is housed within the upper motor assembly and a push rod connects the piston to the lower motor assembly. Through an action caused by intentionally increasing the pressure differential across the piston, the piston exerts a force through the push rod to the lower motor assembly. There, the pushrod is offset from center. Thus, when the force is applied, the lower motor assembly bends in relation to the upper motor assembly.

One embodiment involves a configuration in which the pivoting lower motor assembly is a fluid-powered vane motor. These motors typically have high power-to-length ratios, and are ideal for short radius drilling, particularly when the power section is configured downhole of the bend. The high-speed, low-torque characteristics of vane motors are also well suited for this application. As with most downhole motors, the drilling fluid can be air, gas, drilling mud, or combinations thereof.

Conventional steel may be too rigid to pass through the tight wellbore curvature created by the short radius drilling system. In one embodiment, a flexible conduit such as rubber or composite tubing is utilized to connect to the drilling assembly. The flexible conduit material is selected based on the ability to bend through the tight radius curve, while maintaining enough rigidity to transfer the downward force necessary to keep adequate weight-on-bit for drilling. A flexible conduit with a suitable outer diameter is desirable so as to avoid helical lock-up while applying downward force while drilling. A high speed, low torque motor requires little downward force, thus allowing use of small diameter conduit. In one configuration, several hundred feet of flexible conduit—run beneath conventional drill pipe or coil tubing—is used to convey the short radius drilling system.

While flexible conduit may be adequate to transmit axial push or pull forces, the reactional torque of the motor may cause unacceptable twisting movement. Without the ability to hold a constant tool-face, maintaining orientation for slide drilling would be problematic. In some embodiments, one or more anti-torque devices may be used to resist the resultant drilling torque. The anti-torque device may be configured with one or more axial devices, e.g., axial blades or rollers, that selectively extend from a housing to engage against the wall of the wellbore. The axial device allows relatively free axial forward movement while drilling, yet will still resist the rotary torque of the drilling assembly.

As with any directional drilling operation, survey data and other relevant information must be transmitted from downhole to the operations on the surface. Due to the ultra-short radius capabilities of the drilling assembly, near-bit measurement, would be necessary to get meaningful data necessary to steer the well. In one configuration, magnetically-affected sensors used for measuring azimuth could be located within the non-metallic flexible conduits connecting components of the bottom-hole assembly. The inclination sensor would preferably be located in the lower motor assembly. Additional sensors to measure bend angle of the motor assembly and motor speed would be helpful to operators.

BRIEF DESCRIPTION OF THE DRAWINGS

Illustrative embodiments of the present disclosure are described in detail below with reference to the attached drawing figures, which are incorporated by reference herein.

Figure 1A:
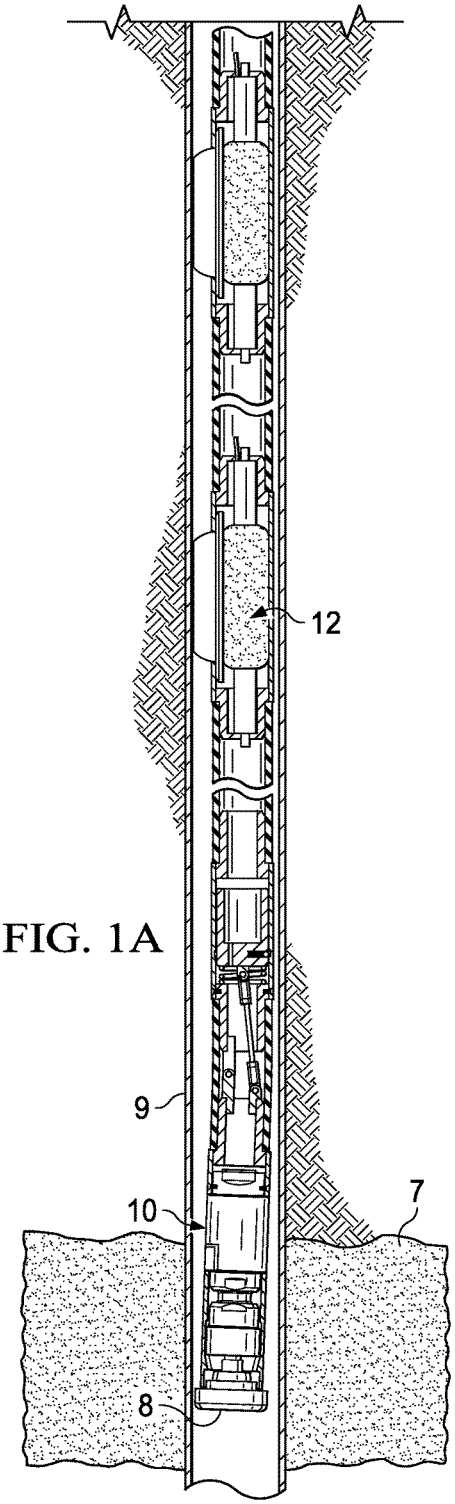
FIG. 1A is a schematic, elevation view with a portion shown in cross section of a bottom-hole assembly being run in a pre-drilled well, according to an illustrative embodiment.

The figures described above are only exemplary and their illustration is not intended to assert or imply any limitation with regard to the environment, architecture, design, configuration, method, or process in which different embodiments may be implemented.

DETAILED DESCRIPTION OF THE ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In the drawings and description that follow, like parts are typically marked throughout the specification and drawings with the same reference numerals or coordinated numerals. The drawing figures are not necessarily to scale. Certain features of the illustrative embodiments may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

Figure 1B:
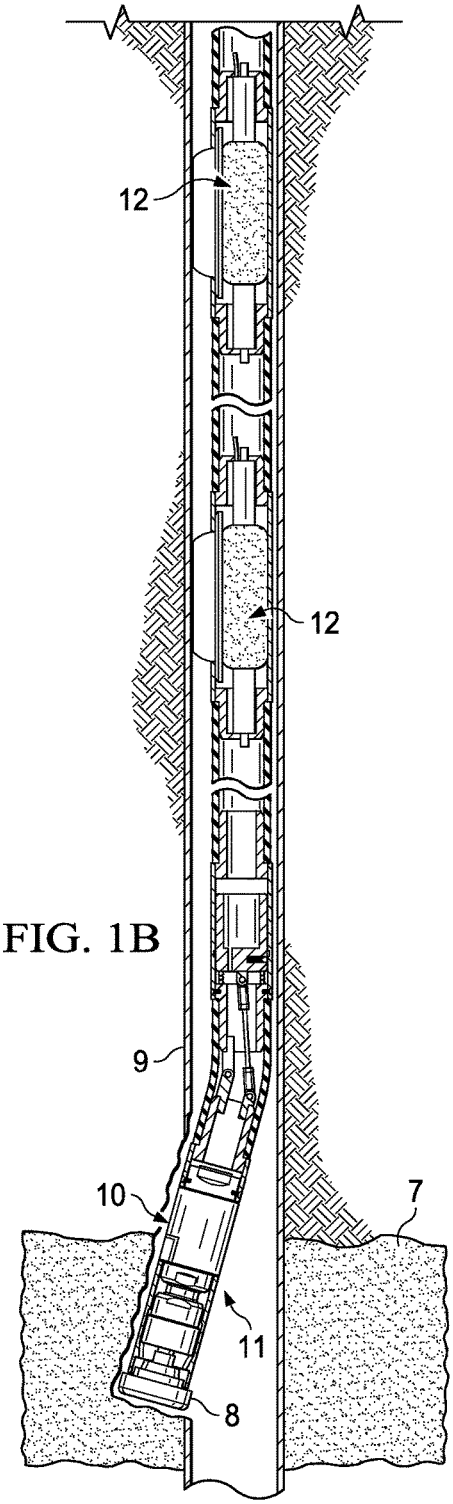
FIG. 1B is a schematic, elevation view with a portion shown in cross section of the bottom-hole assembly of FIG. 1A, but where the bottom-hole assembly exits the pre-drilled well in a bent configuration, according to an illustrative embodiment.
Figure 1C:
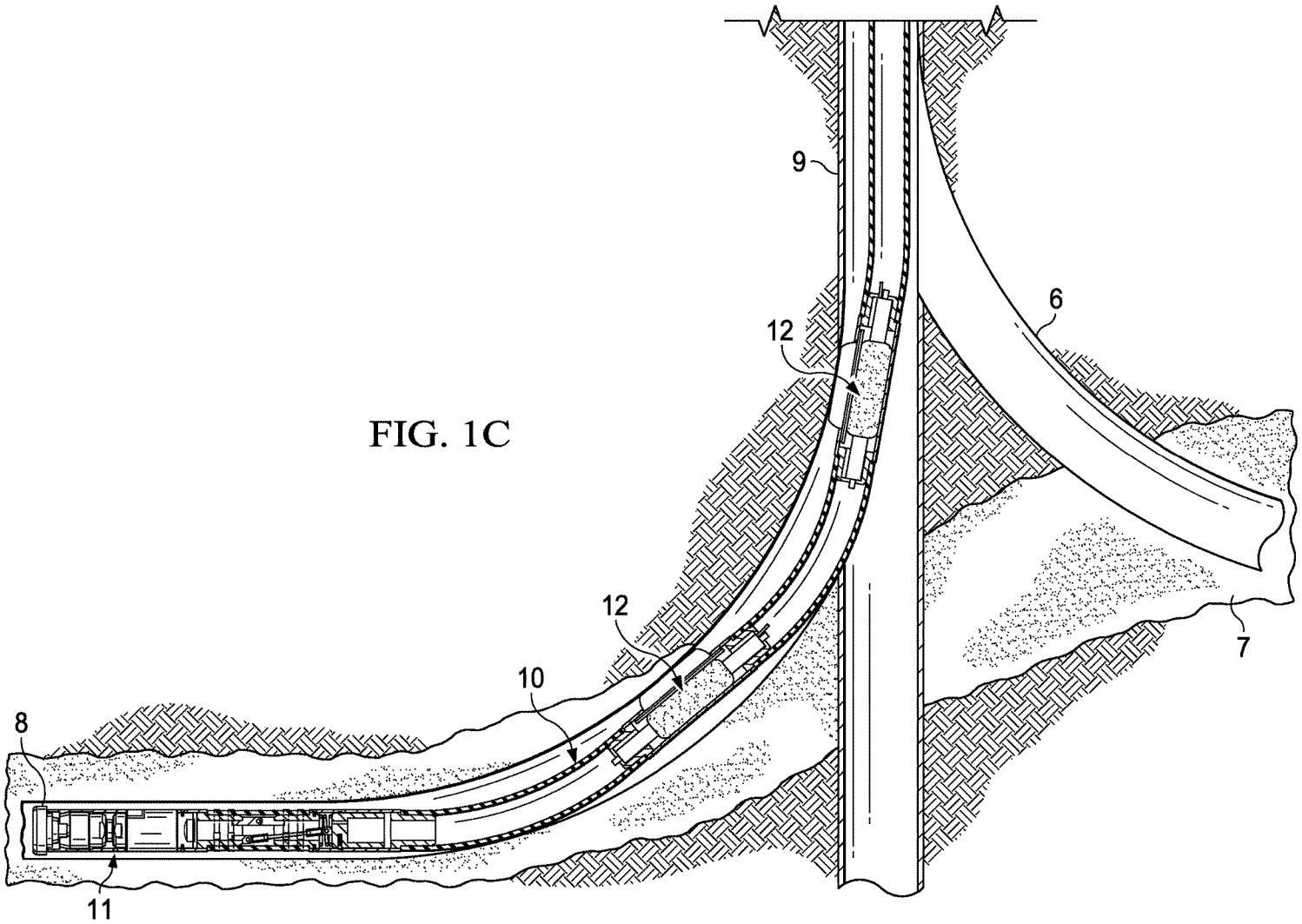
FIG. 1C is a schematic, elevation view with a portion shown in cross section of the bottom-hole assembly of FIG. 1B, but where the bottom-hole assembly is drilling horizontally in a straight configuration after exiting the pre-drilled well, according to an illustrative embodiment.

Referring now to the drawings, FIG. 1A illustrates a bottom-hole assembly 10 while being run in a pre-drilled well 9. A bit 8 is positioned at a point slightly above a target formation in preparation for drilling. FIG. 1B illustrates the drill-motor assembly 11 in the bent configuration exiting the wellbore 9 above the formation 7 in the beginning of drilling a short-radius curve. Anti-torque devices 12 are deployed up-hole of the drill-motor assembly to resist the reactional torque of the bit 8. FIG. 1C illustrates the bottom hole assembly 10 as the well is drilling horizontally. The drill-motor assembly 11 is shown in straight configuration. A previously drilled lateral wellbore 6 is shown having been drilled in the opposite direction.

Figure 2:
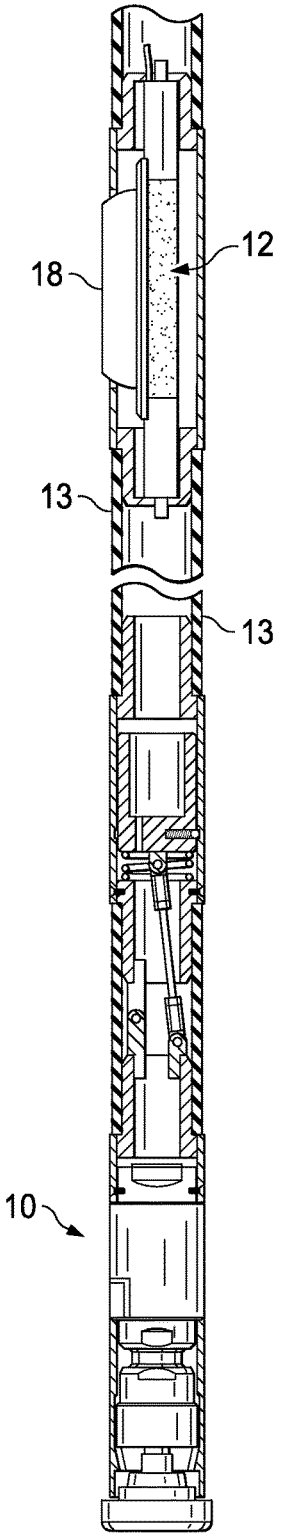
FIG. 2 is a schematic, elevation view with a portion shown in cross section of a bottom-hole assembly in a straight configuration, according to an illustrative embodiment.

FIG. 2 illustrates the bottom-hole assembly 10 in the straight mode of operation. In this configuration, the bottom-hole assembly 10 can be easily run in and out of the straight sections of the well 9 (FIG. 1). This is also the configuration that may be used while the wellbore is established on the correct trajectory, and no changes in azimuth or inclination are desired. Drill-motor assembly 11 and anti-torque device 12 are connected by a flexible conduit 13.

Figure 3:
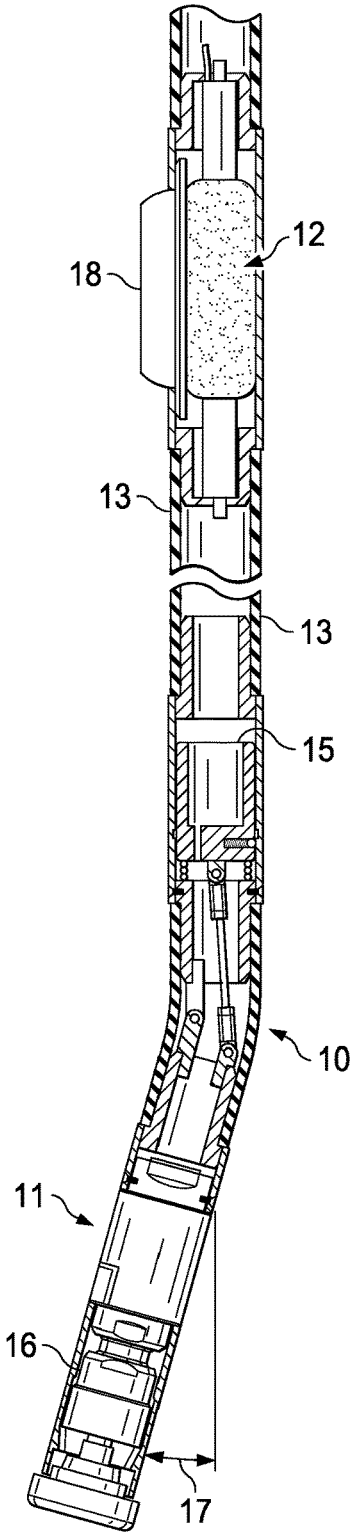
FIG. 3 is a schematic view with a portion shown in cross section of the bottom-hole assembly of FIG. 2, but in an articulated or bent configuration, according to an illustrative embodiment.

FIG. 3 illustrates the bottom-hole assembly 10 in the articulated or bent configuration. This is the configuration that would be used to build angle and change the trajectory of the wellbore. In this configuration, the drill-motor assembly 11 is bent relative to the previously drilled section of the well such that upper motor assembly 15 and lower motor assembly 16 are aligned at an angle 17. In order to maintain tool-face oriented in a constant direction, anti-torque device 12 is shown in an active position with torque anchor blade 18 extended. The length of conduit 13 is relatively short so as to limit the amount of "wind-up" caused by the torque of drilling.

Figure 4:
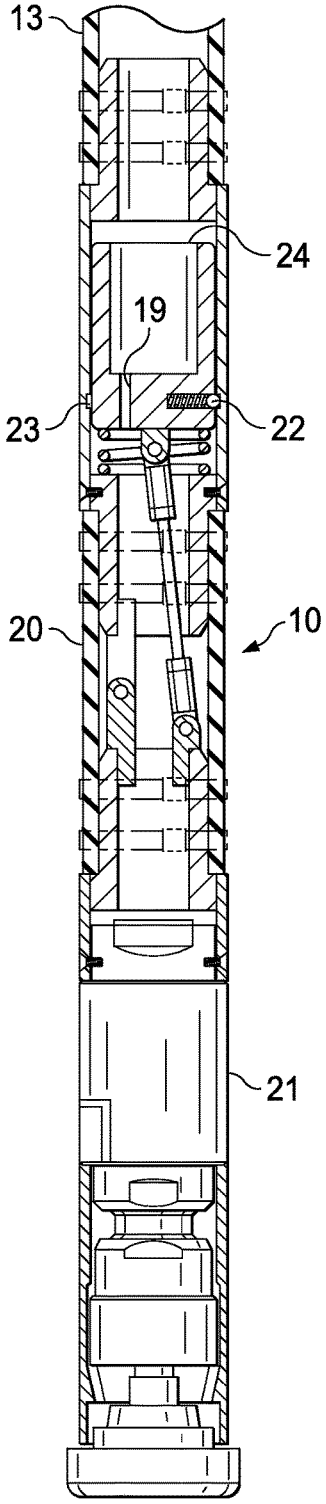
FIG. 4 is a schematic, detail view with a portion shown in cross section of a drill-motor assembly in a straight configuration, according to an illustrative embodiment.

FIG. 4 illustrates the drilling assembly 10 in the straight configuration. Drilling fluid arrives through the flexible conduit 13, then passes through piston orifice 19 and flexible bend element 20 before being delivered to motor 21. During delivery of normal volume rate of drilling fluid, sliding piston 24 is held in place by spring loaded ball 22 and detent ball-seat 23, as the differential pressure of drilling fluid passing through the piston orifice 19 is not sufficient to overcome the restraint.

Figure 5:
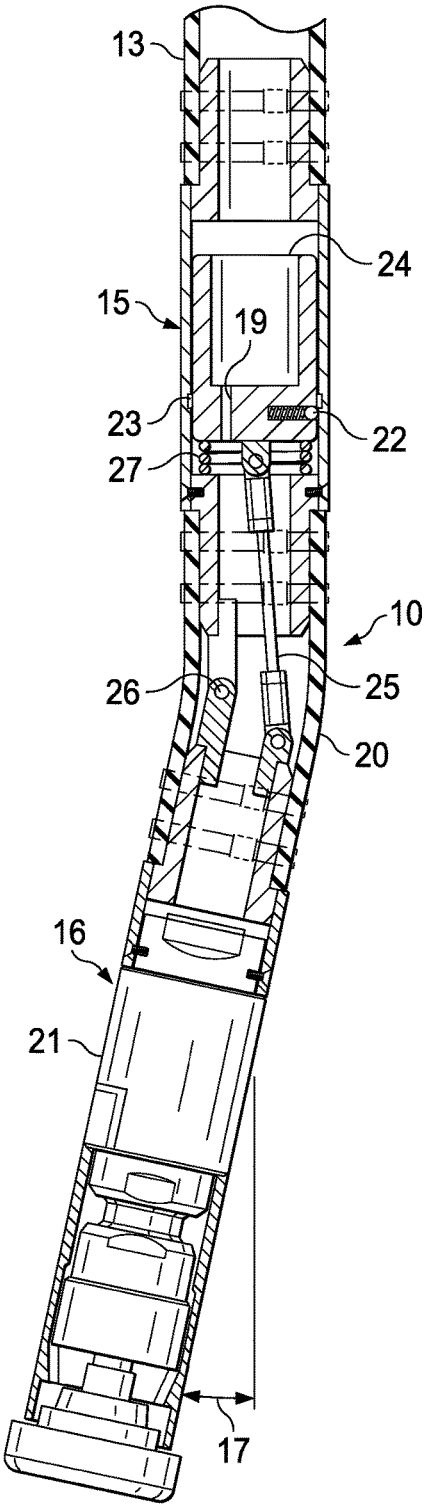
FIG. 5 is a schematic, detail view with a portion shown in cross section of the drill-motor assembly of FIG. 4, but in an articulated or bent configuration, according to an illustrative embodiment.

FIG. 5 illustrates the drilling assembly 10 in the articulated or bent configuration. To activate the bending motion, the delivery rate of the drilling fluid is increased to a point such that the differential pressure of the fluid passing through piston orifice 19 is sufficient to unseat the spring loaded ball 22 from the detent ball-seat 23. Once unseated, the fluid differential pressure causes piston 24 to slide forward, thereby exerting an off-center force against lower motor assembly 16 through actuator arm 25. This off center force causes lower motor assembly 16 to pivot about the hinged axis point 26 connecting lower motor assembly 16 and upper motor assembly 15.

In the bent configuration, the well path will be re-directed towards the direction of the bend. Once the well bore is correctly oriented, the delivery rate of drilling fluid is decreased back to normal level. Differential pressure across piston orifice 19 is decreased, and spring 27 in conjunction with the natural rigidity of flexible bend element 20 attempt to coax upper motor assembly 15 and lower motor assembly 16 back into alignment.

Figure 6A:
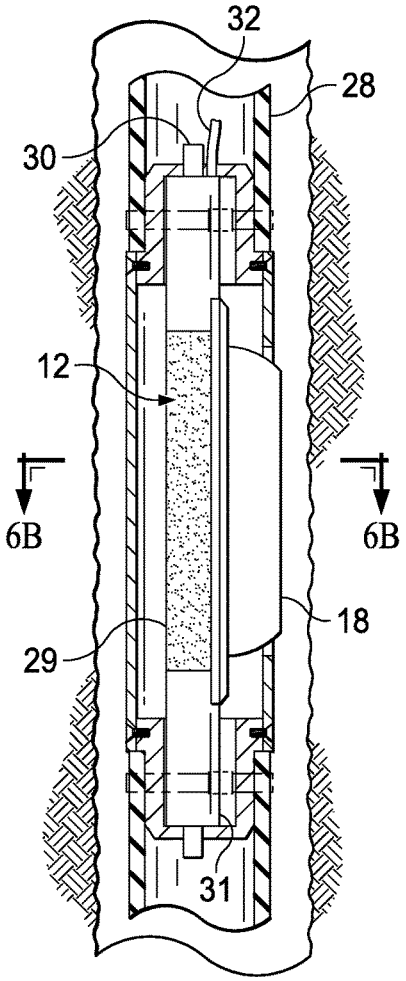
FIG. 6A is a schematic, detail view with a portion shown in cross section of an anti-torque device with a torque-anchor blade retracted, according to an illustrative embodiment.

FIG. 6A illustrates an embodiment of the anti-torque device 12 with a torque-anchor blade 18 retracted, as would be the case for running in and out of the well. Drilling fluid is delivered to the anti-torque device 12 via flexible conduit 28. In one embodiment, housed within the outer body of the anti-torque device 12 is an inflation element 29. The inflation element 29 may be attached to one or more torque-anchor blades 18 such that while the element 29 is deflated, the blade or blades are also retracted within the anti-torque device 12. In another embodiment, a spring force (not shown) may act upon the torque-anchor blades 18 so as to normally maintain them in the retracted position. A single torque-anchor blade 18 may be oriented such that when extended, the geometry of the bottom-hole assembly is further enhanced for ultra-short radius drilling. Alternatively, multiple torque-anchor blades 18 may be concentrically arranged so as to centralize the anti-torque device 12 within the borehole. In either configuration, multiple and aligned short blades may be used in place of a single long blade. Multiple short blades would provide better contact over irregular wellbores.

The inflatable element 29 is fastened at one end to a mandrel 30 through which the drilling fluid flows. The other end of the inflatable element is attached to a sliding sleeve 31 that axially contracts towards the fixed end of the element when inflated. An inflation pressure port 32 is located up-stream of the anti-torque device 12. A detent mechanism (not shown) is arranged within the sliding sleeve 31 fastened to the inflation element 29 such a sufficiently large inflation pressure must build before the sliding sleeve unseats and allows the inflation element 29 to expand. This causes the torque-anchor blades 18 to be in either the fully retracted or fully extended position.

Figure 6B:
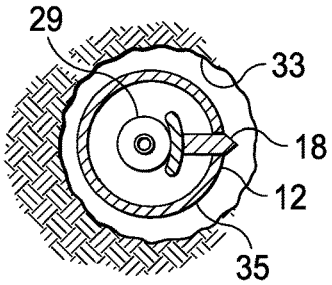
FIG. 6B is a cross-sectional view with a portion shown in cross section of the anti-torque device of FIG. 6A taken along line 6B-6B, showing an inflation element therein at rest, according to an illustrative embodiment.

FIG. 6B illustrates the cross sectional view of the anti-torque device 12 located within the borehole 33 and taken along line 6B-6B of FIG. 6A. As shown, the inflation element 29 is at rest (substantially uninflated), and the torque-anchor blade 18 is largely retracted within the body 35 of the anti-torque device 12.

Figure 7A:
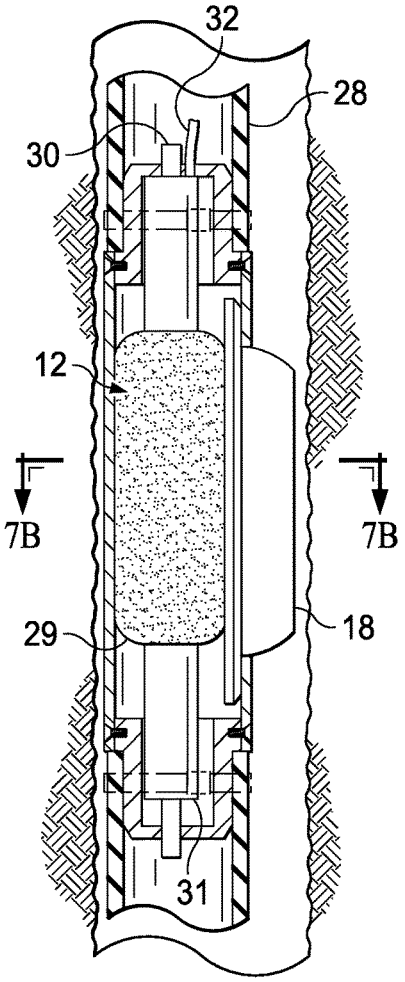
FIG. 7A is a schematic, detail view with a portion shown in cross section of an anti-torque device with a torque-anchor blade extended, according to an illustrative embodiment.

FIG. 7A illustrates the anti-torque device 12 with a torque-anchor blade 18 extended as would be the case for slide drilling. The anti-torque device 12 is particular useful when flexible conduit is used in the drilling process. Depending on the rigidity of the flexible conduit, the anti-torque device 12 may be selectively deployed, or deployed at all times the motor is drilling In the deployed configuration, a certain rate of drilling fluid passing through the mandrel 30 and other down-stream restrictions causes differential pressure to build between the up-stream pressure port 32 and the wellbore annulus, such annulus being fluidly connected to the outer wall of the inflation element 29. Once that differential pressure is sufficient to unseat the sliding sleeve 31 so that the sliding sleeve 31 expands, the torque anchor blades 18 snap into the extended position.

Figure 7B:
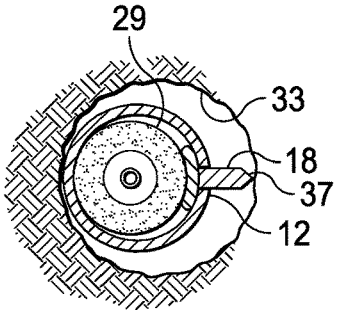
FIG. 7B is a cross-sectional view with a portion shown in cross section of the anti-torque device of FIG. 7A taken along line 7B-7B, showing an inflation element therein expanded, according to an illustrative embodiment.

FIG. 7B illustrates the cross section view taken along line 7B-7B of FIG. 7A of the anti-torque device 12 with the inflation element 29 expanded and the torque-anchor blades 18 in the extended position. The torque-anchor blades 18 are configured so as to resist rotational torque, while still allowing axial movement. In one configuration, a knife edge 37 contacts the wall of the wellbore 33, thus allowing forward sliding movement yet preventing rotation of the bottom-hole assembly.

Figure 8A:
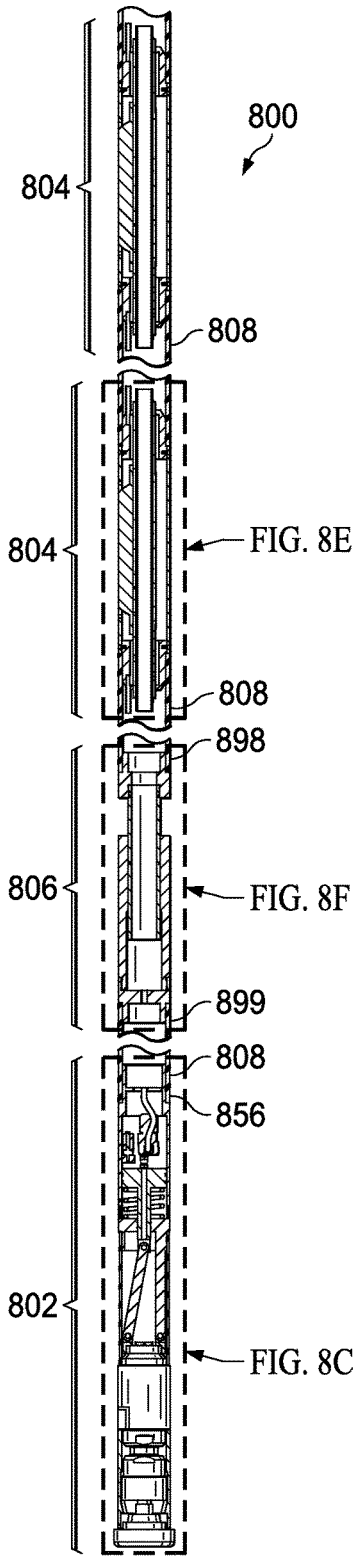
FIG. 8A is a schematic, elevation view with a portion shown in cross section of a downhole system for drilling a wellbore with a portion having a short radius of curvature, but with the downhole system in a straight configuration, according to an illustrative embodiment.
Figure 8B:
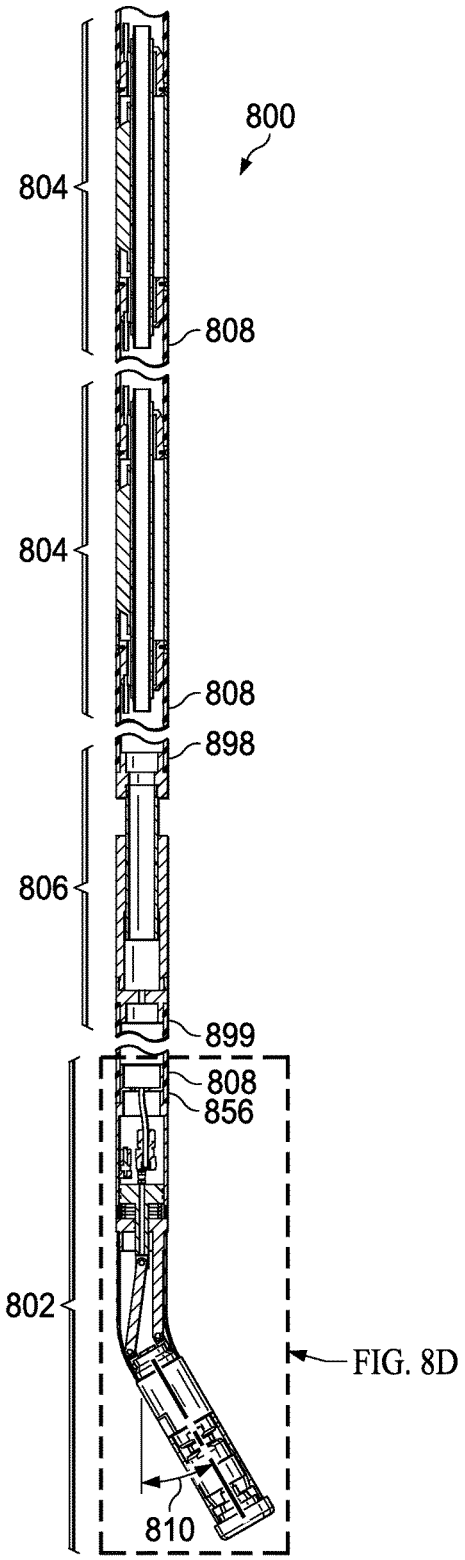
FIG. 8B is a schematic, elevation view with a portion shown in cross section of the downhole system of FIG. 8A, but in a bent configuration, according to an illustrative embodiment.

Now referring primarily to FIG. 8A, a schematic, elevation view, with a portion in cross section, is presented of a downhole system 800 for drilling a wellbore with a portion having a short radius of curvature, according to an illustrative embodiment. As used herein, the term "short radius of curvature" refers to a radius of curvature less than 70 feet (21.3 meters). The downhole system 800 includes a drill assembly 802 and at least one anti-torque anchor 804. The drill assembly 802 is shown articulated in a straight configuration, i.e., not articulated to the bent position. The downhole system 800 may also include an optional shock sub 806, which is typically disposed between the drill assembly 802 and the at least one anti-torque anchor 804. The shock sub 806 is employed so as to provide an axial movement cushioning buffer; this results in a relatively constant force on the bit while the drill string is advanced in discrete increments. The drill assembly 802, the at least one anti-torque anchor 804, and the optional shock sub 806 (when present) are fluidly-coupled by flexible elements 808. Such flexible elements 808 enable the downhole system 800 to articulate, while passing through the portion of the wellbore having a short radius of curvature. Non-limiting examples of flexible elements 808 include pipes or pipe segments comprised of elastomeric or composite materials. Other types of flexible elements 808 are possible. FIG. 8B shows the downhole system 800 of FIG. 8A, but with the drill assembly 802 articulated in a bent position. Associated with the bent position is an angle 810, which will be described further in relation to FIG. 8D.

It will be appreciated that, although FIGS. 8A and 8B present the downhole system 800 as having only the drill assembly 802, the at least one torque anchor 804, and the optional shock sub 806, other components are possible. For example, and without limitation, the downhole system 800 may include a measurement-while-drilling (MWD) tool that contains instruments for providing real-time drilling information (e.g., accelerometers, magnetometers, gamma-sensors, weight-on-bit indicators, torque indicator, annular pressure, articulation angle, etc.). The measurement-while-drilling sensors may be positioned between the drill assembly 802 and the optional shock sub 806, which typically includes fluid coupling through one or more flexible elements 808. In general, however, the downhole system 800 can include other components as needed (e.g., in type, frequency, position, etc.) to address characteristics of the wellbore. Such components are in addition to the drill assembly 802 and the at least one anti-torque anchor 804.

Figure 8C:
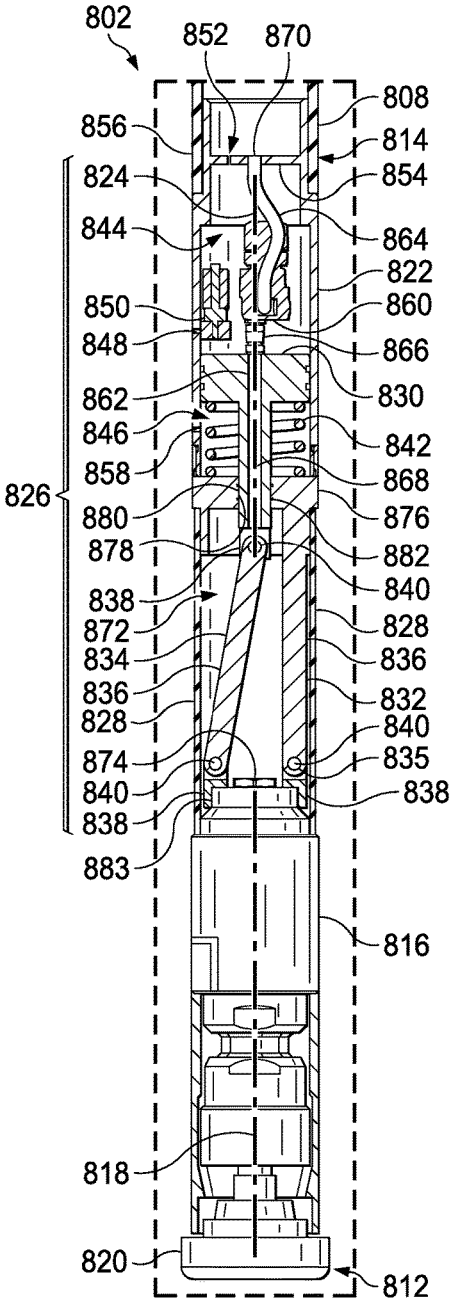
FIG. 8C is a schematic, detail view with a portion shown in cross section of the downhole system of FIG. 8A, showing a drill assembly in the straight configuration.
Figure 8D:
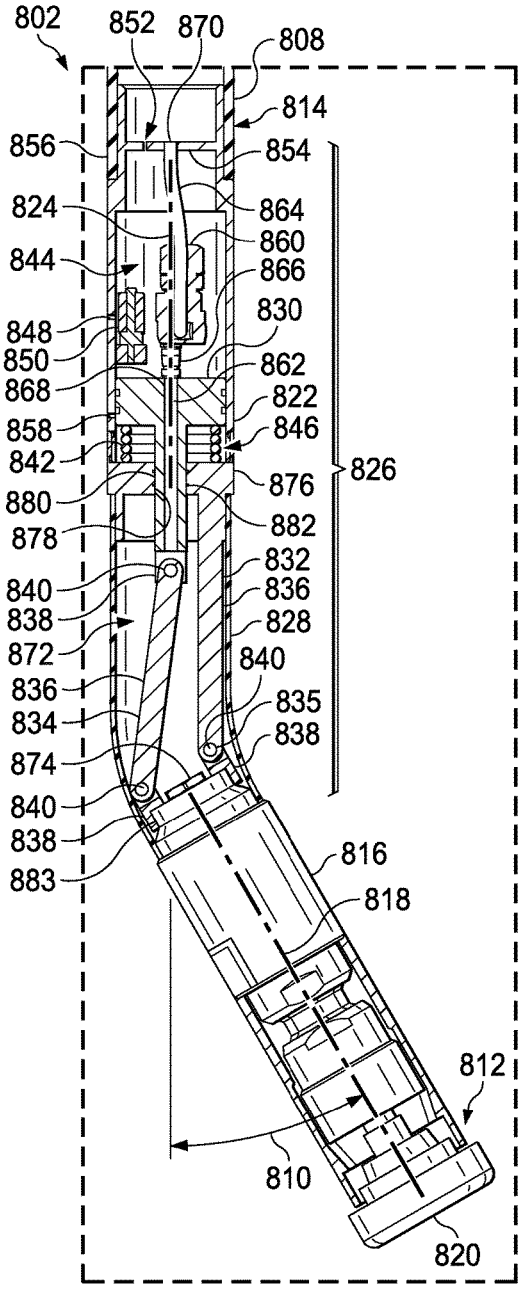
FIG. 8D is a schematic, detail view with a portion shown in cross section of the downhole system of FIG. 8B, showing a drill assembly in the bent configuration.

Referring now primarily to FIGS. 8C and 8D, a schematic, detail view in elevation with portion in cross section is presented of the drill assembly 802 shown, respectively, in FIGS. 8A and 8B. FIG. 8C corresponds to the straight configuration whereas FIG. 8D corresponds to the bent configuration. The drill assembly 802 has a leading end 812 and a trailing end 814. The drill assembly 802 includes a motor 816 having a first longitudinal axis 818. The leading end 812 of the drill assembly 802 is configured to couple a drill bit 820 to the motor 816. The drill assembly 802 also has a tubular housing 822 having a second longitudinal axis 824. An actuator 826 is at least partially disposed within the tubular housing 822 and couples the motor 816 to the tubular housing 822. The actuator 826 is configured to selectively articulate between the straight position, where the first longitudinal axis 818 of the motor 816 is substantially coincident with the second longitudinal axis 824 of the tubular housing 822, and the bent configuration, where the first longitudinal axis 818 of the motor 816 forms the angle 810 with the second longitudinal axis 824 of the tubular housing 822. The drill assembly 802 typically includes a first flexible conduit 828 that facilitates fluid-coupling of the motor 816 to the tubular housing 822. The flexible conduit 828 contains at least a portion of the actuator 826 not disposed within the tubular housing 822.

In some embodiments, the actuator 826 is configured such that the angle 810 corresponding to the bent configuration is at least 4 degrees. In other embodiments, the angle 810 may be between 4-20 degrees (including any number in this range), or even more. The bent configuration is such that the drill assembly can navigate a short-radius curve, e.g., a curve of 70 feet radius or shorter. In some embodiments, the motor 816 is pneumatically powered (e.g., an air-vane motor). In such embodiments, the motor 816 may be a high-speed motor, e.g., a high-speed rotary motor have free-spinning speed greater than 1000 revolutions per minute. In some embodiments, the drill assembly 802 includes one or more sensors for monitoring a performance of the motor 816. Such sensors may include measurement for, vibration , RPM, drilling fluid pressure, and drilling fluid flow rate. Other sensors are possible. In some embodiments, such as that shown in FIGS. 8A-8F, both the motor 816 and the actuator 826 are pneumatically powered. In other embodiments, the motor 816 may be hydraulically powered, which may involve using drilling fluid or mud. In some embodiments, the actuator 826 is hydraulically powered, which may involve drilling fluid or mud (e.g., see FIGS. 1-5).

Referring now primarily to FIGS. 8A-8D, the actuator 826 includes a piston 830 disposed with the tubular housing 822 and operable to translate along the second longitudinal axis 824. The actuator 826 may include a first linkage 832 coupling the motor 816 to the tubular housing 822 and a second linkage 834 coupling the motor 816 to the piston 830. The first linkage 832 provides a stationary pivot point 835 for the motor 816. Optionally, flexible conduit 828 alone may act as a fulcrum against the force of second linkage 834, eliminating the need for first linkage 832. In the second linkage 834, the pivot points are dynamic. In FIGS. 8A-8D, the first linkage 832 and the second linkage 834 are depicted as using elements such as links 836, devises 838, and pins 840. However, this depiction is not intended as limiting. Other types, frequencies and arrangements of elements are possible for the first linkage 832 and the second linkage 834. It will be appreciated that, in general, the piston 830, the first linkage 832, and the second linkage 834 are configured so as to allow the actuator 826 to selectively articulate between the straight position and the full bent position for the drill assembly 802. In some embodiments, the piston 830, the first linkage 832, and the second linkage 834 are configured such that the angle 810 corresponding to the bent configuration is at least four (4) degrees. In some embodiments, the actuator 826 includes a biasing element 842 (e.g., a spring) to predispose the piston 830 towards the trailing end 814 away from the motor 816. In other embodiments, the flexible conduit 828 provides the necessary return biasing force.

With the piston 830, the actuator 826 typically includes a first chamber 844 and a second chamber 846 within the tubular housing 822. The first chamber 844 and the second chamber 846 are separated by the piston 830. During operation, the piston 830 serves to dynamically partition the first chamber 844 and the second chamber 846 while translating along a piston stroke. Such translation alters a first volume of the first chamber 844 at the expense of a second volume of the second chamber 846, or vice versa. The piston stroke is defined by a first position, where the piston 830 is closest to the trailing end 814, and a second position, where the piston 830 is farthest from the trailing end 814. The first position corresponds to the straight position (see FIG. 8C) and the second position corresponds to the full bent position (see FIG. 8D).

In one embodiment, the actuator 826 also includes a first vent port 848 extending from the first chamber 844 to an exterior of the tubular housing 822. A first valve 850 is disposed in the first chamber 844 and fluidly-coupled to the first vent port 848. Such fluid coupling may involve a plurality of fittings or adapters. In some embodiments, the first valve 850 is a normally-open electrically-operated solenoid valve, controlled by a wireline connection to the surface, or remotely controlled via other means. An intake port or orifice 852 in an interior wall 854 is operable to fluidly-couple the first chamber 844 to a second flexible conduit 856. The second flexible conduit 856 is coupled to the trailing end 814 of the drill assembly 802 and is operable to supply pressurized fluid (e.g., air or drilling mud) from a fluid source upstream. The actuator 826 additionally includes a second vent port 858 extending from the second chamber 846 to the exterior of the tubular housing 822. As will be described below, the first vent port 848, the orifice 852, and the second vent port 858 enable the first valve 850 to alter a pressure differential across the piston 830 thus translating the piston 830 along the piston stroke.

A second valve 860 is optionally disposed in the first chamber 844 and coupled to a fluid pathway 862 that passes through at least the piston 830. The fluid pathway 862 is in fluid communication with the motor 816. In some embodiments, the second valve 860 is a pressure-reducing valve configured to limit the pressure of the drilling fluid (e.g., air or drilling fluid (mud)) delivered down-hole to the motor. In other embodiments, the second valve may be configured to prevent flow of drilling fluid to the motor until upstream pressure is sufficient to first deploy the anti-torque device and restrain drilling assembly from rotation. In these embodiments, an example of which is depicted in FIGS. 8A-8D, the fluid pathway 862 may include a flexible hose 864, a series of fittings 866, and a throughbore 868 traversing the piston 830. However, this depiction is not intended as limiting. The fluid pathway 862 may be defined by other types, numbers, and arrangements of elements.

The flexible hose 864 fluidly-couples an intake port 870 in the interior wall 854 to an inlet of the second valve 860. During operation, the flexible hose 864 bends to maintain a continuity of the fluid pathway 862 as the piston 830 translates along the piston stroke. The intake port 870 is operable to convey pressurized fluid from the second flexible conduit 856 into the flexible hose 864. An outlet of the second valve 860 is fluidly-coupled to the throughbore 868 via the series of fittings 866. A third chamber 872, defined in part by the first flexible conduit 828, is operable to receive fluid from the throughbore 868 and convey such fluid to a motor intake 874. The third chamber 872 is separated from the second chamber 846 by a partition 876, which includes a throughole, or passage 878, to accommodate a connecting rod 880 of the piston 830. One or more sealing rings 882 may reside in the passage 878 or on the connecting rod 880 to limit leakage.

In operation, the second flexible conduit 856 supplies a pressurized fluid to the second valve 860 via the intake port 870 and the flexible hose 864. In some embodiments, the pressurized fluid is compressed air at approximately 350 psig. The second valve 860 processes the pressurized fluid, and in doing so, reduces its supply pressure to a delivery pressure. The pressurized fluid then exits the second valve 860 at the delivery pressure and progressively traverses the series of fittings 866, the throughbore 868, and the third chamber 872 to reach the motor intake 874. It will be appreciated that the second valve 860 is typically set by those skilled in the art to yield delivery pressures that match those required for the motor 816. In some embodiments, the pressurized fluid is air and its delivery pressure is approximately 90 psig. The motor 816 consumes pressurized fluid at the delivery pressure in order to rotate the drill bit 820 (i.e., pneumatically powered).

The actuator 826 of the drill assembly 802 may selectively articulate between the straight configuration or the bent configuration including an angle to accommodate a short-radius curve. Such articulation is achieved by triggering the first valve 850, which in turn, manipulates a first pressure in the first chamber 844. When open, the first valve 850 allows pressurized fluid from the intake port, or orifice 852, to traverse the first chamber 844 and exit out the first vent port 848. Thus, the first pressure is approximately equivalent to an exterior pressure. By virtue of the second vent port 858, a second pressure in the second chamber 846 is also approximately equivalent to the exterior pressure. The differential pressure across the piston 830 is therefore insufficient to oppose the biasing element 842, and the piston translates into (or stays in) the first position. The first position corresponds to the straight configuration (see also FIG. 3C).

To articulate the bent position, the first valve 850 is closed. Pressurized fluid enters the first chamber 844 through orifice 852 and slowly increases the first pressure acting against the piston 830. The pressure differential between the first pressure and the second pressure is sufficient to overcome opposition from the biasing element 842. Thus, the piston 830 then translates into (or stays in) the second position. The second position corresponds to a bent configuration (see also FIG. 3D). It will be appreciated that, during operation, the pressurized fluid is often supplied at a magnitude much higher than that needed overcome opposition of the biasing element 842. Such magnitudes may improve an ability of the drill assembly 802 to securely enter into (or stay in) the bent configuration. By periodically cycling the opening and closing of first valve 850, the pressure differential across the piston 830 may be infinitely varied up to the full pressure of the drilling fluid. For example, and without limitation, high pressures in the first chamber 844 (e.g., greater than 200 psig) may be advantageous when initially engaging a wall of the wellbore, i.e., to drill the portion having the short radius of curvature.

To move between the first position and the second position, the piston 830 translates along the piston stoke. This translation displaces the second linkage 834, which is coupled to the piston 830 via the connecting rod 880. Motion of the second linkage 834 occurs concomitant with a force that is applied to an off-center point 883 on the motor 816. In response, the motor 816 pivots about the stationary pivot point 835 of the first linkage 832. Such pivoting generates the angle 810 between the first longitudinal axis 818 and the second longitudinal axis 824.

Figure 8E:
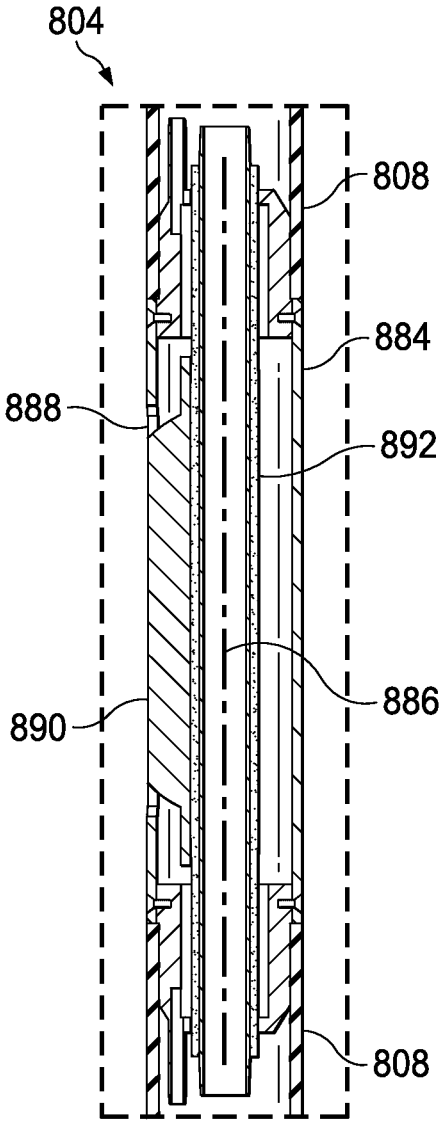
FIG. 8E is a schematic, detail view of at least one anti-torque anchor shown in the downhole system of FIG. 8A.

Now referring primarily to FIG. 8E, a schematic, detail view is presented of the at least one anti-torque anchor 804 shown in FIG. 8A. The at least one anti-torque anchor 804 is fluidly-coupled to the trailing end 814 of the drill assembly 802 and configured to engage the wall of the wellbore such that, when the at least one anti-torque anchor 804 is deployed downhole, a rotational motion of the drill assembly 802 is substantially restrained while a longitudinal (axial) motion is substantially allowed. The at least one anti-torque anchor 804 may be analogous in features and operation to the anti-torque device 12 describe in relation to FIGS. 6A-6B and FIGS. 7A-7B.

In some embodiments, the at least one anti-torque anchor 804 includes a tubular casing 884 having a third longitudinal axis 886 and at least one elongated aperture 888. The at least one elongated aperture 888 is aligned substantially parallel to the third longitudinal axis 886. In such embodiments, the at least one anti-torque anchor 804 also includes at least one blade element 890 (or other axial device, such as a roller) disposed within the tubular casing 884. The at least one blade element 890 is movable between an extended position, where the at least one blade element 890 protrudes out of the tubular casing 884 through the at least one elongated aperture 888, and a retracted position, where the at least one blade element 890 does not protrude out of the tubular casing 884 or at least retracts to be clear of the wellbore wall. The at least one anti-torque anchor 804 additionally includes an inflatable element 892 disposed within the tubular casing 884. The inflatable element 892 is pressurizable between an expanded state and an unexpanded state. Moreover, the inflatable element 892 is positioned relative to the at least one blade element 890 such that, when in the expanded state, the at least one blade element 890 is in the extended position, and when in the unexpanded state, the at least one blade element 890 is in the retracted position. A portion of the inflatable element 892 may be coupled to the at least one blade element 890. In some embodiments, the second flexible conduit 856 directly fluidly-couples the at least one anti-torque anchor 804 to the trailing end 814 of the drill assembly 802 (i.e., the optional shock sub 806 and corresponding upstream flexible element 808 are not present).

Figure 8F:
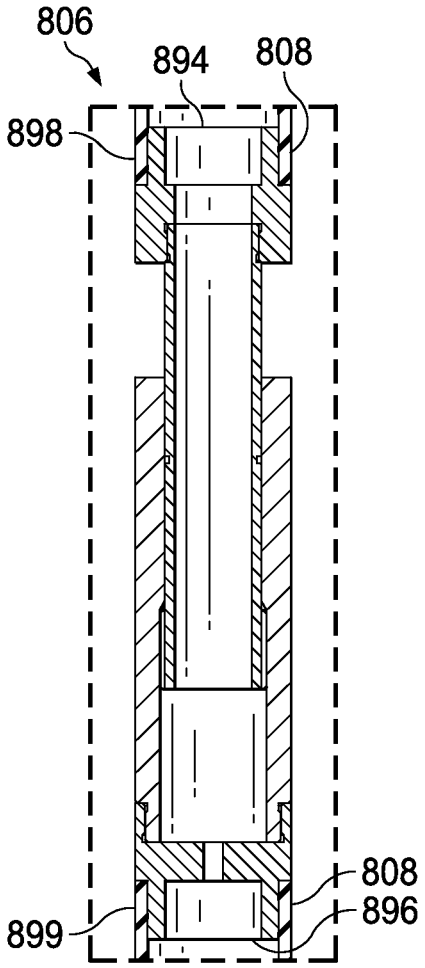
FIG. 8F is a schematic, detail view with a portion shown in cross section of a shock sub shown in the downhole system of FIG. 8A.

Now referring primarily to FIG. 8F, a schematic, detail view is presented of the optional shock sub 806 shown in FIGS. 8A and 8B. The optional shock sub 806 has an inlet 894 and an outlet 896. The inlet 894 is fluidly-coupled to the at least one anti-torque anchor 804 using a third flexible conduit 898. The outlet 896 is fluidly-coupled to the trailing end 814 of the drill assembly 802 using a fourth flexible conduit 899. When the optional shock sub 806 is present in the downhole system 800, the fourth flexible conduit 899 replaces the second flexible conduit 856. The inlet 894 and the outlet 896 allow pressurized fluid traverse the shock sub 806 and flow downstream to the drill assembly 802. The optional shock sub 806 is operational to reduce impacts and vibrations caused during drilling of the wellbore. The shock sub 806 also provides an axial movement cushioning buffer, resulting in a relatively constant force on the bit while the drill sting is advanced in discrete increments. Thus, when present, the optional shock sub 806 enables a substantially constant "weight on bit," or force on the drill bit 820.

Figure 9:
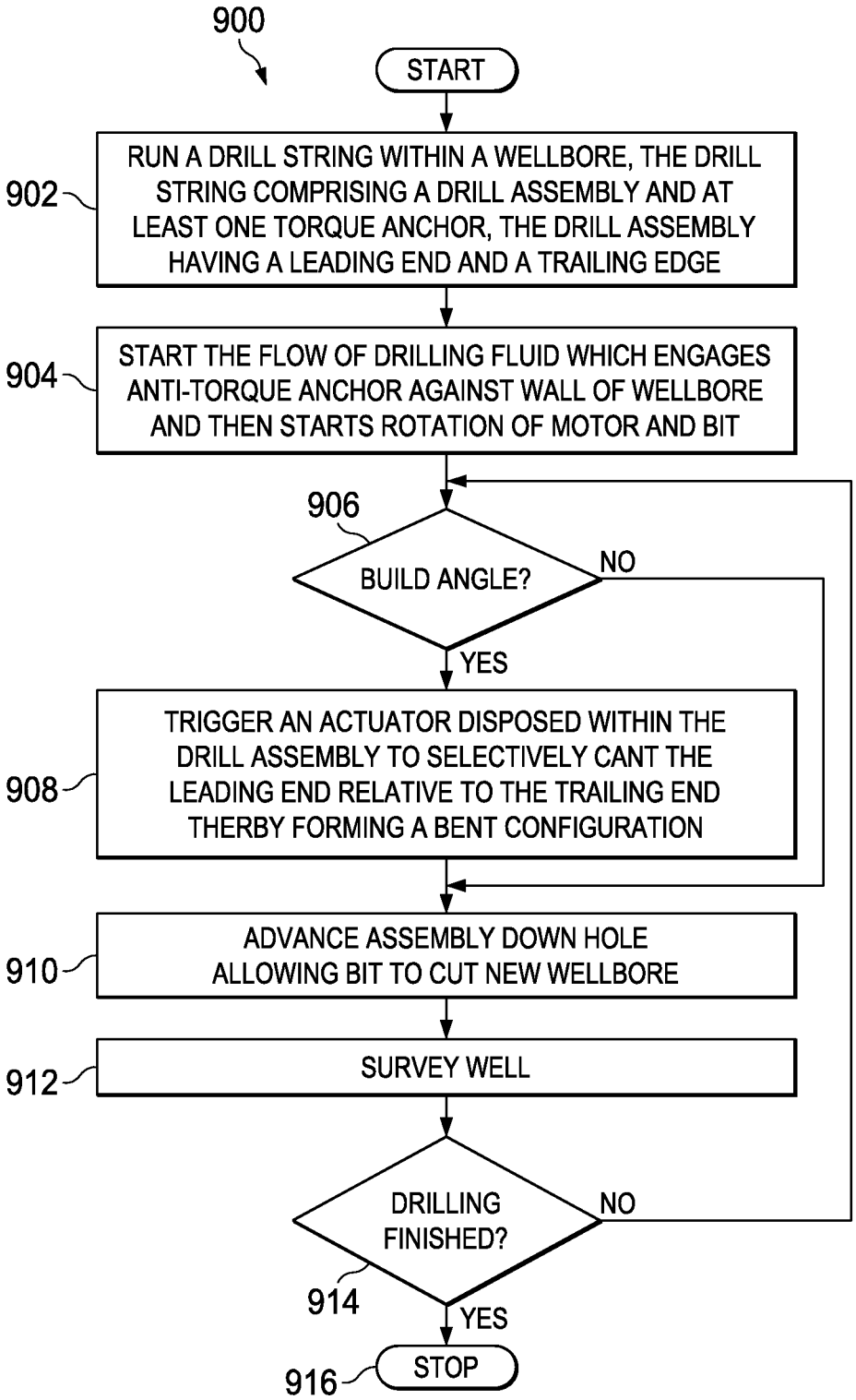
FIG. 9 is a flow chart of an illustrative method for drilling a wellbore with a portion having a short radius of curvature.

Now referring primarily to FIG. 9, a flow chart is presented of an illustrative method 900 for drilling a wellbore with a portion having a short radius of curvature. The method 900 includes the step 902 of running a drill string within the wellbore. The drill string includes a drill assembly with motor and bit and at least one anti-torque anchor. The drill assembly has a leading end and a trailing end. The method 900 also includes the step 904 of starting the flow of drilling fluid that engages the at least one anti-torque anchor against the wall of a wellbore and starting rotation of the motor and bit of the drill assembly. The at least one anti-torque anchor, while engaging the wall of the wellbore with a blade or roller, substantially restrains a rotational motion of the drill assembly while allowing a longitudinal (axial) motion. A decision is then made at interrogatory box 906 as to whether an angle is to be built, or in other words, should the drill assembly be canted or articulated with the leading end being angled relative to the trailing end to form a a bent configuration? If so, the method 900 continues to step 908 and if not then to step 910.

At step 908, an actuator is triggered within the drill assembly to selectively cant the leading end relative to the trailing end to form the bent configuration. This is done using any of the illustrative embodiments previously presented. In some embodiments, the leading end is canted at least 7 degrees (other angles such as 4 to 20 degrees are possible) to reach the bent configuration—other angles are possible as noted above. As step 910, the assembly is advanced down hole allowing the bit to cut the wellbore. The well is surveyed or assessed at step 912 and the resultant data may be used at interrogatory 914 to determine if drilling is complete. If so, the method stops at 916, and if not, the process flow continues back to interrogatory 906.

In some embodiments, the method 900 further includes the step of supplying pressurized fluid through the drill string to the motor and the step of dampening variations in fluid pressure with a shock sub to produce a substantially constant weight on the drill bit. In these embodiments, the shock sub is positioned along the drill string between the drill assembly and the at least one anti-torque anchor.

In some embodiments, the step of triggering the actuator within the drill assembly includes the step of altering a pressure differential across a piston to translate the piston along a piston stroke. In some embodiments, the step of triggering the actuator within the drill assembly includes the step of altering the pressure differential across the piston to translate the piston along the piston stroke and the step of, while altering, displacing a linkage so as to transmit a force to the leading end of the drive assembly. In such embodiments, the linkage couples the piston to an off-center point on the motor.

In some embodiments, the step of energizing the motor includes supplying pressurized air to the motor.

In some embodiments, the step of triggering the actuator within the drill assembly includes altering an air pressure differential across the piston to translate the piston along the piston stroke. In these embodiments, the step of energizing the motor includes supplying pressurized air to the motor. In further embodiments, the air pressure differential is altered by venting air proximate the piston through a port. In such embodiments, the port is in fluid communication with an exterior of the drill assembly and selectively occludable by a valve.

In some embodiments, the downhole system includes a drill assembly having an actuator analogous to those previously presented but configured to articulate between a straight configuration and a full bent position but also able to take an angle anywhere between those two end points.

According to an illustrative embodiment, a method for drilling a wellbore includes running a drill string within the wellbore, the drill string comprising a drill assembly and at least one anti-torque anchor, the drill assembly having a leading end and a trailing end. The method further includes engaging a wall of the wellbore with the at least one anti-torque and energizing a high-speed motor associated with the leading end to rotate a drill bit. The at least one anti-torque anchor, while engaging the wall of the wellbore, substantially restrains a rotational motion of the drill assembly while substantially allowing a longitudinal motion.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order or simultaneous where appropriate. Where appropriate, aspects of any of the examples described above may be combined with aspects of any of the other examples described to form further examples having comparable or different properties and addressing the same or different problems.

It will be understood that the above description of the embodiments is given by way of example only and that various modifications may be made by those skilled in the art. The above specification, examples, and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

The invention claimed is:

1. A method for drilling a wellbore with a portion having a short radius of curvature, which is less than 21.3 meters, the method comprising:

running a drill string within the wellbore, the drill string comprising a drill assembly, a flexible conduit, and at least one anti-torque anchor, wherein the at least one anti-torque anchor comprises at least one selectively deployable anchor device, the drill assembly having a leading end and a trailing end;

engaging a wall of the wellbore with the at least one anti-torque anchor;

triggering an actuator disposed within the drill assembly to selectively cant the leading end relative to the trailing end, thereby forming a bent configuration;

while in the bent configuration, energizing a high-speed motor associated with the leading end to rotate a drill bit;

deploying the at least one anchor device of the at least one anti-torque anchor such that the at least one anchor goes from a retracted position to a deployed position, and wherein the at least one anti-torque anchor, while engaging the wall of the wellbore, substantially restrains a rotational motion of the drill assembly and the drill string while substantially allowing a longitudinal motion; and wherein the step of triggering the actuator within the drill assembly comprises:

altering a pressure differential across a piston within the actuator to translate the piston along a piston stroke, using the piston movement to transmit a force to the leading end of the drive assembly, and wherein a linkage couples the piston to an off-center point on the motor.

2. The method of claim 1, wherein the leading end is canted at least 4 degrees to reach the bent configuration.

3. The method of claim 1, further comprising:

supplying pressurized fluid through the drill string to the high-speed motor;

dampening variations in fluid pressure with a shock sub to produce a substantially constant weight on the drill bit; and wherein the shock sub is positioned along the drill string between the drill assembly and the at least one anti-torque anchor.

4. The method of claim 1, wherein the pressure differential is altered by venting air proximate the piston through a port, the port in fluid communication with an exterior of the drill assembly and selectively occludable by a valve.

5. A method for drilling a wellbore with a portion having a short radius of curvature, which is less than 21.3 meters, the method comprising:

running a drill string within the wellbore, the drill string comprising a drill assembly and at least one anti-torque anchor, the drill assembly having a leading end and a trailing end;

engaging a wall of the wellbore with the at least one anti-torque anchor;

triggering an actuator disposed within the drill assembly to selectively cant the leading end relative to the trailing end, thereby forming a bent configuration;

while in the bent configuration, energizing a high-speed motor associated with the leading end to rotate a drill bit;

wherein the at least one anti-torque anchor, while engaging the wall of the wellbore, substantially restrains a rotational motion of the drill assembly and the drill string while substantially allowing a longitudinal motion; and wherein the step of triggering the actuator within the drill assembly comprises:

altering a pressure differential across a piston within the actuator to translate the piston along a piston stroke, using piston movement to transmit a force to the leading end of the drive assembly, and wherein a linkage couples the piston to an off-center point on the motor.

6. A method for drilling a wellbore with a portion having a short radius of curvature, which is less than 21.3 meters, the method comprising:

running a drill string within the wellbore, the drill string comprising a drill assembly and at least one anti-torque anchor, the drill assembly having a leading end and a trailing end;

engaging a wall of the wellbore with the at least one anti-torque anchor;

triggering an actuator disposed within the drill assembly to selectively cant the leading end relative to the trailing end, thereby forming a bent configuration;

while in the bent configuration, energizing a high-speed motor associated with the leading end to rotate a drill bit;

wherein the at least one anti-torque anchor, while engaging the wall of the wellbore, substantially restrains a rotational motion of the drill assembly and the drill string while substantially allowing a longitudinal motion;

wherein the step of triggering the actuator within the drill assembly comprises altering an air pressure differential across a piston within the actuator to translate the piston along the piston stroke;

wherein the step of energizing the motor comprises supplying pressurized air to the motor; and wherein the air pressure differential is altered by venting air proximate the piston through a port, the port in fluid communication with an exterior of the drill assembly and selectively occludable by a valve.

* * * * *